US005348202A

United States Patent [19]

Lee

[11] Patent Number: 5,348,202

[45] Date of Patent: Sep. 20, 1994

[54] TUBULAR REFRACTORY PRODUCT

[75] Inventor: Stephen J. Lee, Cardross, Great Britain

[73] Assignee: Thor Ceramics Limited, Clydebank, Scotland

[21] Appl. No.: 37,997

[22] Filed: Mar. 25, 1993

Related U.S. Application Data

[63] Continuation-in-part of Ser. No. 399,453, Oct. 27, 1989, abandoned, and a continuation of Ser. No. 667,985, Mar. 30, 1993, Pat. No. 5,198,126.

[30] Foreign Application Priority Data

Feb. 28, 1987 [GB] United Kingdom ..... 8704764

[51] Int. Cl.[5] ..... B22D 41/22

[52] U.S. Cl. ..... 222/606; 222/600

[58] Field of Search ..... 222/600, 606, 607, 591; 266/236

[56] References Cited

U.S. PATENT DOCUMENTS

| | | | |
|---|---|---|---|
| 4,108,675 | 8/1978 | Tomita et al. | 222/600 |
| 4,179,046 | 12/1979 | Jeschke et al. | 222/600 |
| 4,738,380 | 4/1988 | King | 222/606 |

FOREIGN PATENT DOCUMENTS

| | | |
|---|---|---|
| 080672A2 | 6/1983 | European Pat. Off. . |
| 0171487 | 2/1986 | European Pat. Off. . |
| 0198123 | 10/1986 | European Pat. Off. . |
| 0198237 | 10/1986 | European Pat. Off. . |
| 2816283 | 10/1978 | Fed. Rep. of Germany . |
| 1576778 | 10/1980 | Fed. Rep. of Germany . |
| 56-14060 | 2/1981 | Japan . |
| 62-158562 | 7/1987 | Japan . |

*Primary Examiner*—Scott Kastler

*Attorney, Agent, or Firm*—Watts Hoffmann Fisher & Heinke

[57] ABSTRACT

A refractory pouring-assembly component for use with a tube changer mechanism, the component having a throughbore for pouring of molten metal during continuous casting from a tundish into a mould and being isostatically pressed from different heat- and wear-resisting reffactories to form a one-piece composite body having at one end a smooth, flat plate surface in which there is defined an aperture, at least the peripheral edge around said aperture being formed of a hard refractory material to provide a cutting edge around the through-bore, whilst the remainder of said body is formed from a thermal shock-resistant material to provide for pouring of melt.

13 Claims, 2 Drawing Sheets

TUBULAR REFRACTORY PRODUCT

Prior Related Applications

The present application is a continuation-in-part of application Ser. No. 399,453, filed Oct. 27, 1989, now abandoned, and a continuation of Ser. No. 667,985, now U.S. Pat. No. 5,198,126, dated Mar. 30, 1993, and International application Ser. No. PCT/GB88/00139 filed on Feb. 29, 1988, and which designated the U.S. The prior applications in turn claim foreign priority of Great Britain Application 8704764 filed Feb. 28, 1987.

BACKGROUND OF THE INVENTION

This invention relates to a refractory product for use in continuous casting. More particularly, the invention is concerned with tubular refractory products for use in pouring of melt from the tundish to the mould. Flow of melt from the tundish into a mould is commonly controlled by raising or lowering of a refractory stopper rod from or to a seating position in the base of the tundish where there is located either a fixed sub-entry nozzle (SEN) or a tundish nozzle, built into the tundish base, onto which a sub-entry shroud (SES) is fastened. In place of stopper rod valve closures, a slide gate control mechanism to which the SEN or SES is attached is also known.

Recently some steelmakers have been fitting to the underside of the tundish a fairly simple mechanism which enables quick changeover of such pouring tubes to minimize loss of time and production in replacing worn or damaged tubes. Such tube changer is described in GB-A-1 597 215 whilst another is disclosed in EP-A-0 192 019. When an SES is cracked or worn out, the mechanism rapidly pushes out the used piece and drives a new tube into alignment underneath the metal stream, for example, by means of a piston arrangement.

The present systems use an upper nozzle having a seating position to receive a flow control stopper located within a well block fixed into the tundish lining against which a stationary plate is fitted and incorporating a suitable jointing arrangement between the two components. A lower assembly is held in place against the underside of this stationary plate by the tube changer mechanism and comprises a moving plate and submerged pouring shroud jointed by a suitable arrangement and retained within a strengthening steel shell which serves to hold the two components firmly together and to withstand the pressures transmitted by the operating piston.

Whilst improvement have been made in the tube-changing mechanisms since their introduction, there remain problems in ensuring adequate fitting of the respective mating surfaces of the tube, nozzle and upper or stationary plate and the lower or sliding plate of the tube changer and the submerged pouring shroud. If improper fitting of these refractory components occurs, then air/oxygen leakage through the misfitting joints is possible with detrimental effect upon the quality of the steel. Air/oxygen penetrating the joints reacts with the alumina in the steel leading to build up of alumina deposits and clogging of the pouring tube. Such reaction also yields a problem manifesting itself as inclusion in the casting commonly identified as black spot.

Thus, those in this field have hitherto sought to mitigate such problems by seeking to improve the tube handling and change-over systems leading to ever more complex and expensive handling systems.

SUMMARY OF THE INVENTION

An object of the present invention is to obviate or mitigate the aforementioned problems by providing improved pouring tubes suitable for use in conjunction with bottom pouring metallurgical vessels and existing tube changers, thereby obviating the need for further development of the changer mechanisms.

Accordingly, the present invention provides a refractory pouring assembly component suitable for use with a tube-changing mechanism to provide a replaceable pouring means comprising an elongate tubular body having a throughbore for pouring of molten metal during continuous casting from a tundish into a mould wherein the refractory pouring component is isostatically pressed from different refractory compositions that impart selected thermal shock and wear-resisting properties into a one-piece composite body which is shaped to provide at one end a smooth, flat plate surface in which there is defined an aperture, at least the peripheral edge around said aperture being formed of a hard refractory material to provide an edge which, during a tube-changing operation, is capable of cutting a skin or shell of solidified melt formed within the throughbore of the pouring assembly during pouring of molten metal therethrough, whilst the remainder of said body is formed to a tubular shape from a thermal shock-resistant material to provide for pouring of melt.

In one embodiment, the end of the one-piece member that defines the flat plate surface is made from a refractory which is harder and more wear-resistant than the main part of the tubular body, while the main part of the tubular body is made from another refractory composition which is softer and has greater thermal shock resistance than the fiat plate surface.

Alternatively, a co-pressed configuration is possible whereby an annulus around the aperture in the flat plate surface is made from a material having the requisite strength, thermal shock resistance and physical compatibility with the remaining plate and body material. This, of course, requires controlled packing of the isostatic-pressing mould in a manner known per se using materials selected in accordance with this invention.

In both embodiments, the harder, wear-resistant refractory may be an alumina, silica, zirconia, carbon composition. The components of this material are usually such that the alumina exceeds about 45% by weight, while the silica and zirconia are present in lesser amounts such that the zirconia may exceed the quantity of silica and still allow a small quantity of carbon to be included. A desirable composition comprises 53% alumina, 18% silica, 24% zirconia and 3% carbon with the balance being minor amounts of typical materials used in this art. The softer refractory material which makes up the main part of the tubular body and provides the desired thermal shock resistance may consist principally of an alumina, silica, carbon composition.

The refractories making up the one-piece composite member of the invention can be bonded in a suitable manner, such as by resin which forms a carbonaceous bond after firing. Alternatively, the component can be bonded by silicon nitride or oxy-nitride materials selected from the group consisting of alumina/graphite, zirconia/graphite, magnesia/graphite, and mixtures thereof.

Thus, the invention approaches the problem of imperfect seals with a new solution in that totally new refractory components are used in the pouring assembly. Each of the previously sliding upper and lower plates of the tube changer system, the tundish bottom nozzle or block, and the pouring tube is now replaced. In place of the previously used four components, two components are provided by this invention, thereby eliminating two of the troublesome joints in the pouring/changer assembly. If desired, it is possible only to replace the lower plate of the tube changer and the conventional pouring tube with a composite tube/slide plate of this invention since this is the region normally most subject to wear and leakage caused by tube changing. Previously, this would not have been contemplated due to the fundamentally different tasks of the respective components of the four-piece assemblies. The plates of the tube changer have to be sufficiently hard as to be able to sever cleanly the frozen melt skin or shell formed during pouring of melt through the assembly whilst the pouring tube leading from the changer plates into the mould must be capable of withstanding thermal shocks. These requirements are generally considered to be opposing in that a material having suitable hardness characteristics is of generally poor resistance to thermal shock and vice versa. However, it is now surprisingly found that it is possible to make in a single step a refractory component having the requisite hardness and thermal shock-resistant properties using the above-mentioned materials or the like.

As mentioned above, the invention may be applied to the upper tube changer fixed plate/tundish block or nozzle parts of the pouring assembly or to the lower sliding plate/pouring tube parts of the pouring assembly. Best advantages are obtained with replacement of all known components with the new composite components of this invention.

DESCRIPTION OF THE PREFERRED EMBODIMENTS

EXAMPLE 1

Figure 1:
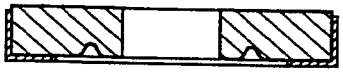
Fig.1 (PRIOR ART)
FIG. 1 is a section through a conventional lower slide plate of a tube changer.
Figure 2:
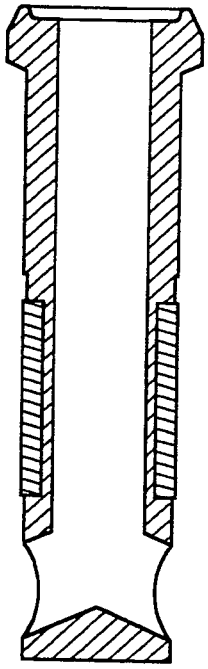
Fig.2 (PRIOR ART)
FIG. 2 is a section through a conventional pouring tube adapted to mate with the lower slide plate shown in FIG. 1.
Figure 3:
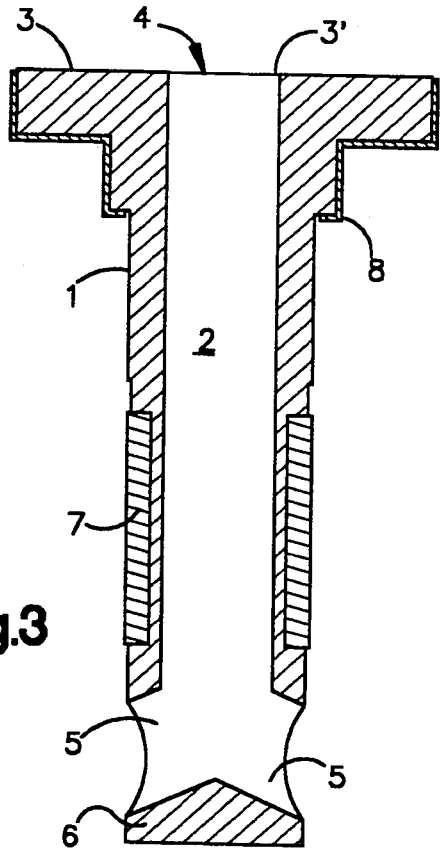
FIG. 3 is a section through a pouring tube of this invention which replaces the components shown in FIGS. 1 and 2.

Referring to FIG. 3 of the drawing, a refractory pouring body 1 having a throughbore 2, for use with a tube-changing mechanism to provide a replaceable means for pouring of molten metal during continuous casting from a tundish into a casting mould, is isostatically pressed from powder refractory materials and binders selected to impart thermal shock and wear-resisting properties to the refractory one-piece composite body 1 which is formed by the isostatic pressing. The pressing operation to mould the refractory powder material is carried out in a manner generally known per se using a flexible mould to provide a shaped refractory body 1 having at one end of the body a flat plate surface 3 whilst the remainder of the body 1 is of generally cylindrical shape. Arbors and sacrificial void formers (if necessary) are inserted in the mould which is packed with the powder refractory/binder materials in order to provide in the pressed composite an axial throughbore 2 extending from an aperture 4 in the plate 3 to divergent outlets 5 at the tip 6 of the pouring body 1. By selecting refractory materials as described in Tables I and II, using suitable binders and with appropriate filling and packing of the mould, it is possible to provide a wear-resistant plate 3 and a peripheral edge 3' around said aperture 4 which, during a tube-changing operation, is capable of cutting a skin or shell of solidified melt formed within the throughbore of the pouring assembly during pouring of the molten metal therethrough, while ensuring that the main tubular part of the body 1 has the desired thermal shock resistance. Since the embodiment under discussion is intended for use as a submerged entry nozzle, a band 7 of wear-resistant refractor material such as zirconia or high zirconia/graphite mix is provided in a manner known per se. Further, the known means of preventing physical damage during handling by the tube changer, i.e., a protective metal can 8 is fitted after normal finishing of the refractory composite. These finishing steps may include fine grinding of the plate surface 3.

In use of the tube changer handles, the composite refractory in much the same way as for the known two-part assembly, using the underside of the metal can 8 to receive thrust to locate the support, the composite pouring tube for use beneath either the conventional two-part upper changer plate and tundish nozzle or the new composite of this invention as will be described herein below.

EXAMPLE 2

Figure 4:
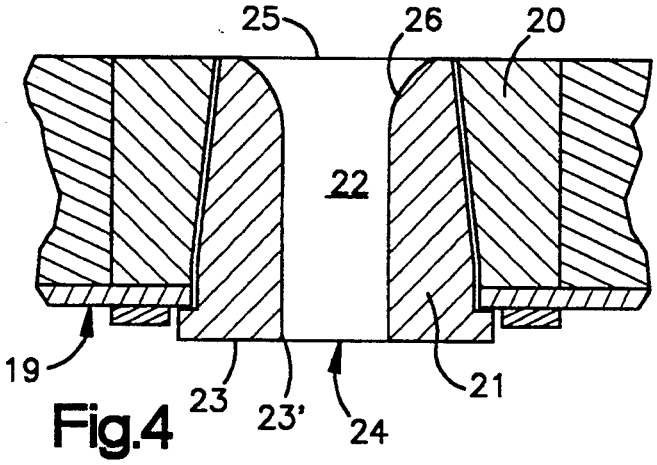
FIG. 4 is a section through a pouring nozzle with an integral upper changer plate for fixing in the bottom of a tundish to form the upper part of a pouring assembly provided in accordance with this invention.

Referring to FIG. 4 of the drawing, a refractory pouring nozzle 21 for lócation in the well block 20 in the bottom of a tundish 19 has a throughbore 22 and an integrally formed plate surface 23 for use with a tube-changing mechanism during continuous casting from a tundish into a casting mould is isostatically pressed from powder refractory materials and binders selected (as discussed hereinbefore) to impart thermal shock and wear-resisting properties to the refractory one-piece composite body 21. The pressing operation to mould the refractory powder material is carried out in a manner generally known per se using a flexible mould to provide a shaped refractory body 21 having at one end of the body a flat plate surface 23 whilst the remainder of the body 21 is optionally of tapered or cylindrical shape. Arbors and sacrificial void formers (if necessary) are inserted in the mould which is packed with the powder refractory/binder materials in order to provide in the pressed composite an axial throughbore 22 extending from an aperture 24 in the plate 23 to inlet 25 having a shape adapted to provide a seating surface 26 for a stopper (not shown). By selecting refractory materials as described in Tables I and II, bonded with suitable binders and with appropriate filling and packing of the mould, it is possible to provide a plate surface 23 having the desired wear resistance and a hard peripheral edge 23′ around said aperture 24 which, during a tube-changing operation, is capable of cutting a skin or shell of solidified melt formed within the throughbore of the pouring assembly during pouring of molten metal therethrough, whilst the main part of the body 21 may be optionally formed of a thermal shock-resistent material. Normal finishing of the refractory which may include fine grinding of the plate surface 23 is carried out.

EXAMPLE 3

Figure 5:
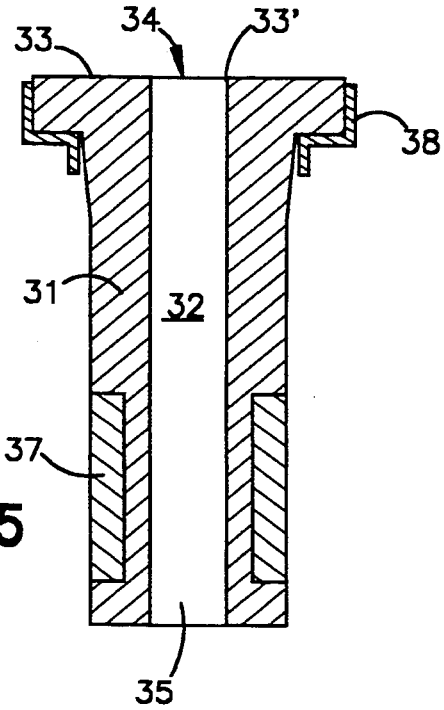
FIG. 5 is a section through a pouring component (SES) with an integral lower slide changer plate for presentation to a corresponding upper plate in an upper part of a pouring assembly provided in accordance with this invention.

A further embodiment of the invention is shown in FIG. 5 of the drawings. In this case, a submerged entry shroud (SES) is shown and it is formed in a manner generally equivalent to that described in Example 1 to provide a refractory pouring body 31 with a through-bore 32 and at one end of the body 31 a flat plate surface 33, whilst the remainder of the body 31 is of generally cylindrical shape for use with a tube-changing mechanism as described before. Again, by selecting appropriate refractory materials as described in Tables I and II, it is possible to provide a plate surface 33 which is wear-resistant and a hard peripheral edge 33′ around said aperture 34 which, during a tube-changing operation, is capable of cutting a skin or shell of solidified melt formed within the through-bore of the pouring assembly during pouring of molten metal therethrough, while the main part of the tubular body 31 is formed of a thermal shock-resistant material. Since the embodiment under discussion is intended for use as a submerged entry shroud, a band 37 of wear-resistant refractory material such as zirconia or high zirconia/graphite mix is provided in a manner known per se.

As before, to prevent physical damage during changing a protective metal can 38 is fitted, and normal finishing of the refractory composite which may additionally include fine grinding of the plate surface 33, is carried out.

EXAMPLE 4

Figure 6:
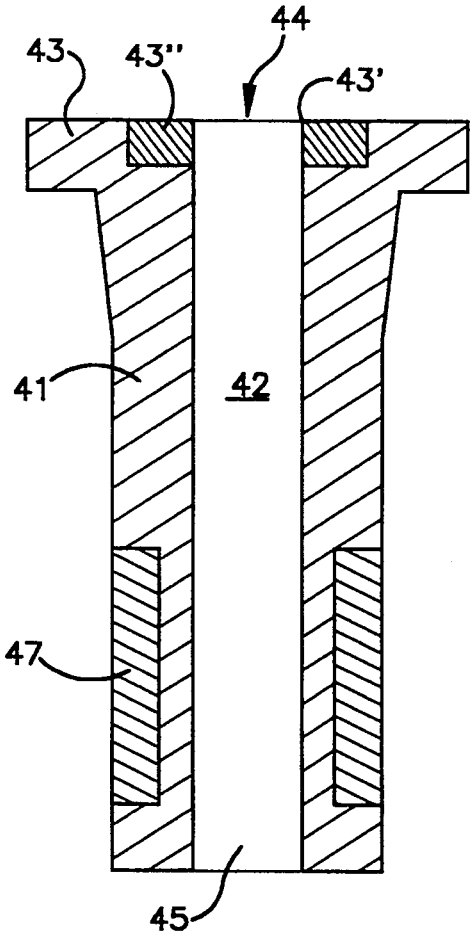
FIG. 6 is a section through another embodiment of a pouring component (SES) similar in function to that of FIG. 5.

As shown in FIG. 6, it is also possible to prepare the SES so that the outer plate 43 has a region 43″ around the aperture 44 in the plate surface 43 made from a refractory material which exhibits the required hardness and mechanical strength to operate as the "cutting edge 43′ during the tube change, together with total compatibility with the physical properties of the remaining alumina/silica/graphite body 41. In this embodiment, an exemplary composite includes 53% alumina, 18% silica, 24% zirconia and 3% carbon (as graphite) with the balance being minor amounts of typical materials used in this art. In other respects, this embodiment is similar to that of Example 3 and parts thereof are numbered in an analogous fashion. Since the unit is manufactured in a single copressing step, there is no risk of steel penetration at the interface.

The advantages of this invention are that the proposed pouring assembly by using upper and lower components of isostatically pressed graphitised alumina/-silica or graphitised alumina/silica zirconia mix or the like, heat resisting, wear-resisting ceramic materials produces a high integrity rigid system which completely eliminates two the previous high risk joints, thereby reducing the disadvantages of gas leakage. This leads to less build-up of alumina and choking of the pouring tubes. Another advantage lies in the improved control of the movable system arising from the rigidity of the new system. Additionally, by supplying a composite pouring body, there is a reduction of on-site assembly work which makes for improved quality control.

Referring to the following Table I, the first two columns list various properties of prior art slide gate (SG) plates and sub-entry shrouds (SES), while the remaining columns list the properties of the preferred materials employed in carrying out the present invention. The columns under heading (b) indicate the properties of the plate which is part (3) in FIG. 3, part (23) in FIG. 4, part (33) in FIGS. 5, as well as the annulus (4Y) in FIG. 6, and the properties of the shroud which is the tubular body portion of part (1) in FIG. 3, part (21) in FIG. 4, part (31) in FIG. 5 and part (41) in FIG. 6. The columns under heading (a) show the properties of refractory material which can be used as a blend between the plate and shroud materials. Table II lists the preferred and exemplary compositions for the plate in the embodiments of FIGS. 3–5, as well as the annulus in the embodiment of FIG. 6, and for the shroud or main tubular body portion in all embodiments.

TABLE I

| | | | PREFERRED MATERIAL PROPERTIES | | | | | |
|---|---|---|---|---|---|---|---|---|
| | | | COMMON BODY (a) | | COMPATIBLE CO-PROCESS PHASES plate (b) | | shroud | |
| Property | SG Plate | SES | range | typical | range | typical | range | typical |
| Bulk Density g/cc | 3.05–3.15 | 2.15–2.40 | 2.55–2.68 | 2.62 | 2.77–2.91 | 2.86 | 2.25–2.45 | 2.38 |
| App. Porosity % | 5–20 | 14–20 | 13–15.6 | 14.3 | 14–17.2 | 15.7 | 15–19 | 17.0 |
| Cold Crushing Strength $MN/m^2$ | 137–157 | 20.6–28.5 | 47–60 | 54.4 | 150–170 | 162 | 16.2–21.5 | 18.8 |
| Modulus of Rupture $MN/m^2$ | 45.7–52.3 | 6.0–9.5 | 16–20.5 | 18.4 | 49–57 | 54 | 5.5–7.5 | 6.3 |
| Hot Modulus 1500° C. $MN/m^2$ | 12.7–15.7 | 6.0–8.8 | 14–18 | N/A | 12.5–15 | 14 | 5.3–7.3 | 6.2 |
| Thermal Expan. 1500° C. % | 0.9–1.3 | 0.2–0.4 | 0.5–0.7 | 0.6 | 0.6–0.85 | 0.8 | 0.3–0.5 | 0.4 |

TABLE II

| | Compatible Co-Pressed Phases | | | |
|---|---|---|---|---|
| Material | plate range % | plate typical % | shroud range % | shroud typical % |
| $Al_2O_3$ | 51–55 | 53 | 50–54 | 52 |
| $SiO_2$ | 16.5–18.5 | 18 | 13–16 | 15 |
| $ZrO_2$ | 23.5–27 | 24 | 0 | 0 |
| C | 2–4 | 3 | 28–32 | 31 |
| Matrix Bond | 1.5–2.5 | 2 | 1–4 | 2 |

Whilst the present invention has been described with reference to preferred embodiments, it will be appreciated by those skilled in the art that the invention may be practiced otherwise than as specifically described herein without departing from the spirit and scope of the invention. It is therefore to be understood that the spirit and scope of the invention be limited only by the appended claims.

I claim:

1. A refractory pouring assembly component constructed for use with a tube changer mechanism in the continuous casting of steel, said component having a throughbore and being formed of varying refractory compositions exhibiting different wear and thermal shock-resisting properties which are pressed together and co-molded to form a one-piece composite member, said member including an end portion defining a flat plate surface having an opening from said throughbore and a tubular main body portion, the member having a joint free transition from said end portion to said main body portion, said end portion having a peripheral edge around said opening formed of a first wear-resistant refractory composition which is comparatively harder than said tubular main body portion, and said tubular main body portion being formed throughout its length from another refractory composition which is more thermal shock-resistant and softer than said peripheral edge formed from said first composition.

2. The component as claimed in claim 1 wherein said component constitutes a lower sliding plate and pouring tube of the refractory pouring assembly, and said main body portion has an elongate, tubular shape adapted to extend into a casting mold.

3. The component as claimed in claim 1 wherein said component constitutes an upper fixed plate and nozzle of the refractory pouring assembly, and wherein said throughbore has an inlet at the end of said body portion opposite to said plate surface.

4. The component as claimed in any one of claim 1, wherein all of said plate surface is formed from said first composition.

5. The component as claimed in any one of claim 1, wherein said end portion includes an annulus which defines said peripheral edge and is formed from said first composition.

6. The component as claimed in any one of claims 1, 4 or 5 wherein said first composition consists essentially of alumina, silica, zirconia and carbon, and said another composition consists essentially of alumina, silica and carbon.

7. The component as claimed in any one of claims 1, 2 or 3 wherein said first composition has a bulk density of about 2.77–2.91 g/cc, an apparent porosity of about 14–17.2%, a cold crushing strength of about 150–170 $MN/m^2$, a modulus of rupture of about 49–57 $MN/m^2$, a hot modulus of rupture at 1500° C. of about 12.5–15 $MN/m^2$, and thermal expansion at 1500° C. of about 0.6–0.85%, and said another composition has a bulk density of about 2.25–2.45 g/cc, an apparent porosity of about 15–19%, a cold crushing strength of about 16.2–21.5 $MN/m^2$, a modulus of rupture of about 5.5–7.5 $MN/m^2$, a hot modulus of rupture at 1500° C. of about 5.3–7.3 $MN/m^2$, and thermal expansion at 1500° C. of about 0.3–0.5%.

8. The component as claimed in claim 6 wherein said first composition consists essentially of about 55–55% alumina, about 16.5–18.5% silica, about 23.5–27% zirconia, and about 2–4% carbon, and said another composition consists essentially of about 50–59% alumina, about 13–16% silica, and about 28–32% carbon.

9. A refractory pouring assembly component constructed for use with a tube changer mechanism in the continuous casting of steel, said component having a throughbore and being formed of varying refractory compositions exhibiting different wear and thermal shock-resisting properties which are pressed together and co-molded to form a joint free one-piece composite member having an end portion including a flat plate surface and a main body portion, said end portion being formed from a first refractory composition having less thermal shock resistance but greater hardness than said main body portion, and said main body portion being formed throughout from another refractory composition having greater thermal shock resistance and lower hardness than said end portion.

10. The component as claimed in claim 9 wherein said component constitutes a lower sliding plate and pouring tube of the refractory pouring assembly, and said main body portion has an elongate, tubular shape adapted to extend into a casting mold.

11. The component as claimed in claim 9 wherein said component constitutes an upper fixed plate and nozzle of the refractory pouring assembly, and wherein said throughbore has an inlet at the end of said body portion opposite to said plate surface.

12. The component as claimed in claim 9 wherein said first composition has a bulk density of about 2.77–2.91 g/cc, an apparent porosity of about 14–17.2%, a cold crushing strength of about 150–170 $MN/m^2$, a modulus of rupture of about 49–57 $MN/m^2$, a hot modulus of rupture at 1500° C. of about 12.5–15 $MN/m^2$, and thermal expansion at 1500° C. of about 0.6–0.85%, and said another composition has a bulk density of about 2.25–2.45 g/cc, an apparent porosity of about 15–19%, a cold crushing strength of about 16.2–21.5 $MN/m^2$, a modulus of rupture of about 5.5–7.5 $MN/m^2$, a hot modulus of rupture at 1500° C. of about 5.3–7.3 $MN/m^2$, and thermal expansion at 1500° C. of about 0.3–0.5%.

13. The component as claimed in claim 9 wherein said first composition consists essentially of about 55–55% alumina, about 16.5–18.5% silica, about 23.5–27% zirconia, and about 2–4% carbon, and said another composition consists essentially of about 50–59% alumina, about 13–16% silica, and about 28–32% carbon.

* * * * *